US008141300B2

(12) United States Patent
Heckmann et al.

(10) Patent No.: US 8,141,300 B2
(45) Date of Patent: Mar. 27, 2012

(54) ADJUSTMENT OF A MOTORIZED POSITIONING DEVICE

(75) Inventors: Felix Heckmann, Coburg (DE); Klaus Wagner, Untermerzbach (DE); Detlef Russ, Ebersdorf (DE)

(73) Assignee: Brose Fahrzeugteile GmbH & Co. Kommanditgesellschaft, Coburg (DE)

( * ) Notice: Subject to any disclaimer, the term of this patent is extended or adjusted under 35 U.S.C. 154(b) by 169 days.

(21) Appl. No.: 12/476,021

(22) Filed: Jun. 1, 2009

(65) Prior Publication Data

US 2009/0293361 A1 Dec. 3, 2009

Related U.S. Application Data

(63) Continuation of application No. PCT/EP2007/010444, filed on Dec. 1, 2007.

(30) Foreign Application Priority Data

Dec. 1, 2006 (DE) ..... 20 2006 018 289 U

(51) Int. Cl.
*E06B 3/00* (2006.01)

(52) U.S. Cl. ..... 49/506; 49/349

(58) Field of Classification Search ..... 49/348, 49/349, 506; 318/283, 286, 466, 468, 471, 318/461

See application file for complete search history.

(56) References Cited

U.S. PATENT DOCUMENTS

| | | | | |
|---|---|---|---|---|
| 5,487,002 | A * | 1/1996 | Diller et al. | 701/1 |
| 6,263,272 | B1 * | 7/2001 | Liu et al. | 701/49 |
| 6,548,979 | B2 * | 4/2003 | Boisvert et al. | 318/469 |
| 7,170,244 | B2 * | 1/2007 | Choby | 318/280 |
| 7,751,946 | B2 * | 7/2010 | Taki et al. | 701/2 |
| 7,765,058 | B2 * | 7/2010 | Doering | 701/123 |
| 2002/0101210 | A1 * | 8/2002 | Boisvert et al. | 318/469 |
| 2002/0121872 | A1 * | 9/2002 | Boisvert et al. | 318/469 |
| 2002/0157313 | A1 | 10/2002 | Fukazawa et al. | |
| 2004/0183493 | A1 * | 9/2004 | Boisvert et al. | 318/469 |
| 2007/0055415 | A1 * | 3/2007 | Taki et al. | 701/2 |
| 2007/0285218 | A1 * | 12/2007 | Fletcher et al. | 340/457 |
| 2008/0103660 | A1 * | 5/2008 | Browne et al. | 701/46 |
| 2008/0120175 | A1 * | 5/2008 | Doering | 705/14 |
| 2009/0005936 | A1 * | 1/2009 | Browne et al. | 701/45 |

FOREIGN PATENT DOCUMENTS

| | | | |
|---|---|---|---|
| DE | 100 14 072 | B4 | 5/2004 |
| EP | 1 077 354 | A2 | 2/2001 |
| JP | 2009280017 | A * | 12/2009 |

* cited by examiner

*Primary Examiner* — Jerry Redman

(74) *Attorney, Agent, or Firm* — Muncy, Geissler, Olds & Lowe, PLLC

(57) ABSTRACT

A method for calibrating a powered actuator for use in a vehicle is provided, with regard to an end position of an actuating element which is easy to achieve and conserves easily damaged mechanical components of the actuator made from plastic, rubber or similar. According to an example embodiement, in a calibrating step, the actuator is operated with recording and analysis of an actuation speed measured parameter such that the actuating element is moved in the direction of the end position and reaching the end position is recognized when the value of the actuation speed measured parameter reaches or drops below a given threshold. A temperature parameter characterizing the temperature of the actuator is evaluated before or during the calibration process. The calibration step is then only carried out if the value of the temperature parameter does not exceed an upper temperature limit. An actuator suitable for carrying out said method is also disclosed.

11 Claims, 1 Drawing Sheet

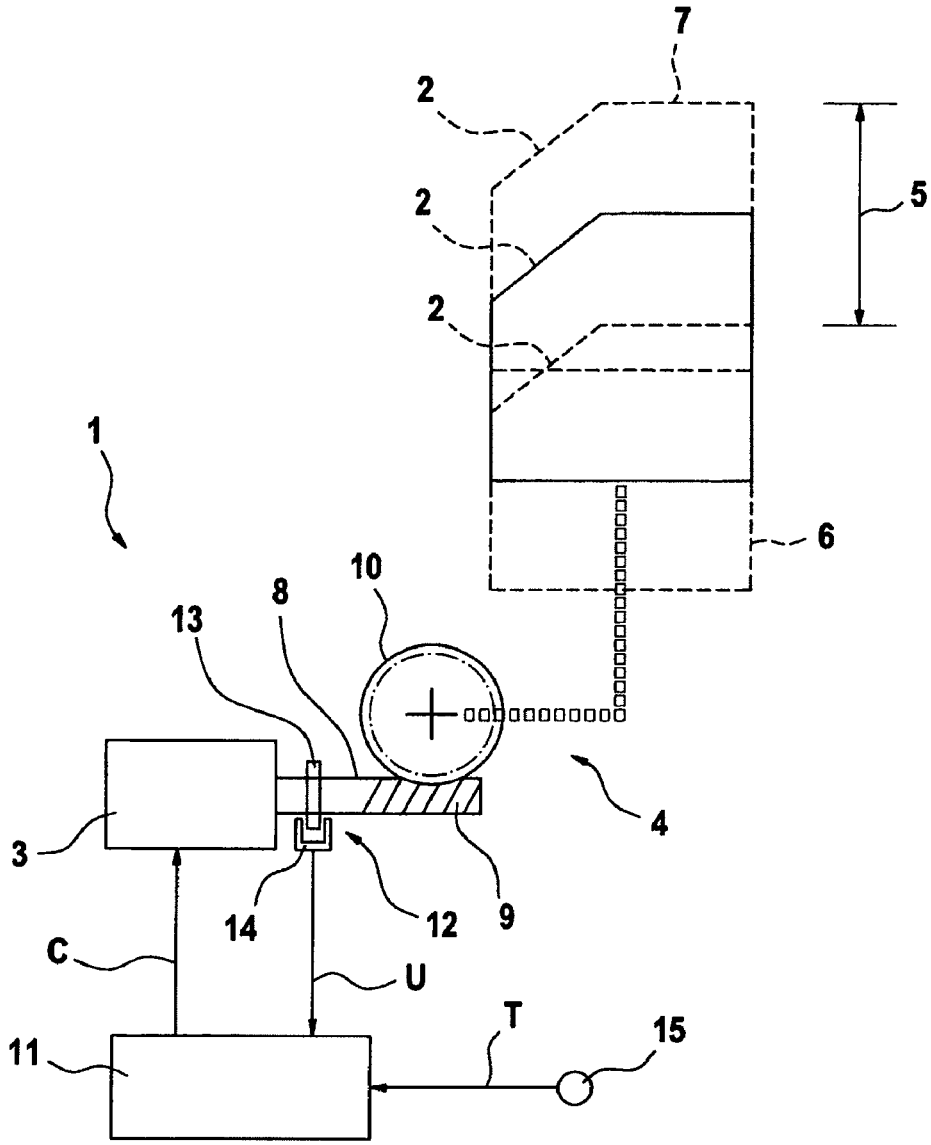
7
2
2
2
5
1
6
10
8
13
4
3
14
12
9
C
U
T
15
11

ADJUSTMENT OF A MOTORIZED POSITIONING DEVICE

This nonprovisional application is a continuation of International Application No. PCT/EP2007/010444, which was filed on Dec. 1, 2007, and which claims priority to German Patent Application No. 20 2006 018 289.6, which was filed in Germany on Dec. 1, 2006, and which are both herein incorporated by reference.

BACKGROUND OF THE INVENTION

1. Field of the Invention

The invention relates to a method for adjusting a positioning device that can be used in a vehicle, in particular an electric window opener, with regard to an end position. The invention also relates to a positioning device provided for carrying out the method.

2. Description of the Background Art

Motorized positioning devices are used in automotive engineering, in particular as motorized window openers. However, the invention also relates to positioning devices which are provided for the motorized adjustment of sunroofs, vehicle doors, seats or other vehicle components.

A conventional positioning device can include an electric positioning motor, which is coupled via a positioning mechanism to the vehicle component to be adjusted, i.e. in particular a vehicle window, in such a way that the vehicle component, which is hereinafter referred to as the positioning element, is movable along a predefined travel path between two end positions. In the case of a window opener, these end positions are predefined by the closed position and the open position of the vehicle window. The positioning mechanism of a positioning device of this type usually comprises a driving worm, coupled with the drive shaft of the positioning motor, as well as a worm gear that meshes therewith.

To equalize production tolerances and thus ensure that the window is always completely closed while the positioning device is in operation, at least the closed position is often not entirely predefined in the case of a window opener. Instead, the positioning device for the window opener is not adjusted to the closed position of the vehicle window until after the positioning device has been installed in the vehicle. With regard to this adjustment operation, this is also referred to as "training" the positioning device. For training purposes, the vehicle window is moved in the direction of the closed position until it is held in place against the vehicle body. The reaching of the closed position is detected by the fact that the positioning speed—or at least a measured variable that is characteristic thereof—comes to a stop. The closed position of the window determined in this manner is usually stored in a control unit of the positioning device. During normal operation, the window is usually stopped by the positioning device shortly before coming into contact with the vehicle body. However, the adjustment process described above is usually repeated regularly, for example after 50 load cycles in each case. The repeated adjustment of the positioning device is also referred to as "memorization".

In some vehicle models, it is alternatively provided at the outset to have the positioning device always move the vehicle window to the limit stop.

If the window is moved to the limit stop, the mechanical stress transmitted from the vehicle body to the vehicle window is absorbed by the positioning device. As a result, the worm gear of the positioning mechanism, in particular, is placed under tension against the driving worm at a torque of typically up to 5-20 Nm. This stress may cause a deformation of the worm gear, which is usually made of plastic. This deformation may impair the functionality of the positioning device. In particular, a deformation of the worm gear may cause the positioning mechanism to run out of true. This, in turn, may impair further functionalities of the positioning device, for example the functionality of any automatic anti-trap control system that may be provided.

SUMMARY OF THE INVENTION

It is therefore an object of the present invention to provide a method for adjusting a positioning device with regard to an end position, this method being easy to implement and protecting mechanical components of the positioning device that are susceptible to damage, in particular components made of plastic, rubber or the like. Another object of the invention is also to provide a device that is particularly suitable for carrying out this method.

According to an embodiment of the invention, it is provided that, by detecting and analyzing the positioning speed measured variable, the positioning device in operated in an adjustment step in such a way that the positioning element to be adjusted is moved in the direction of an end position to be determined, the reaching of the end position being detected by the fact that the value of the positioning speed measured variable reaches or drops below a predetermined threshold value. According to the invention, a temperature parameter which is characteristic for the temperature of the positioning device is evaluated before or during the adjustment step, the adjustment step being carried out only if the value of the temperature parameter does not exceed a predefined upper limit temperature.

The invention is based on the knowledge that the mechanical components of the positioning device to be protected according to the object of the invention, in particular the worm gear, which has proven to be particularly sensitive in practice, are particularly susceptible to deformation, particularly at high temperatures. At a high external temperature and/or in the presence of strong sunlight, temperatures that reach or exceed 80° C. may indeed occur in typical installation environments of a positioning device, in particular in a vehicle door. Under these circumstances, the plastic of the worm gear or any further plastic components of the positioning mechanism are relatively soft and tend toward plastic deformation under mechanical tension.

Since the adjustment step according to the invention is permitted only within a predefined temperature interval, the risk of damage to the positioning mechanism is significantly reduced without it being necessary to deviate from the usual design with regard to the positioning mechanism or from the usual method for carrying out the actual adjustment step. In particular, the method according to the invention allows plastic parts, which are particularly advantageous as a result of their manufacturing costs and weight, to be used as components of a positioning mechanism without having to take into account the risk of damage conventionally associated with training or memorization.

The term "positioning speed measured variable" used above includes the positioning speed of the positioning element as well as any variable which may be derived from this positioning speed, in particular the rotational speed of the positioning motor, the motor current of the positioning motor, etc. The term "temperature parameter" likewise includes the temperature present in the designated installation location of the positioning device, as well as any variable which may be derived from this temperature.

In an embodiment, the temperature of the positioning device is directly detected by a temperature sensor within or outside the device. As an alternative thereto, a temperature inside or outside the vehicle is used as the temperature parameter. The temperature inside or outside the vehicle is preferably detected by an external vehicle component, for example an on-board computer, and provided to the positioning device via a CAN bus line or another data communications link. In turn, it is alternatively provided that a calculated positioning motor temperature is used as the temperature parameter. In a conventional positioning device, this positioning motor temperature is frequently calculated in any case by an overheating protection system which is provided therein as standard equipment, and this temperature is therefore already available in many conventional positioning devices.

The threshold value of the positioning speed measured variable used as a condition for detecting the end position is preferably set to zero so that, in this case, the reaching of the end position is detected by the fact that the positioning speed comes to a complete stop. To rule out measurement errors, it is optionally provided that the system determines when the positioning speed measured variable reaches or drops below the threshold value only upon reaching the end position, in particular when it reaches or drops below the value zero for a length of time exceeding a predefined delay period.

In an embodiment, the upper limit temperature can be suitably set to a value between 40° C. and 60° C., in particular to 50° C.

It should be understood that excessively cold temperature may also promote damage to the worm gear or other plastic components of the positioning mechanism, since the plastic material is particularly brittle and tends to break. Excessively low temperatures may, in some circumstances, also cause the upper limit stop not to be approached and thus faulty post-normalization takes place.

In addition to the upper limit temperature, therefore, a lower limit temperature is set in another embodiment. The adjustment step in this embodiment being carried out only if the value of the temperature parameter does not drop below this lower limit temperature, i.e., if the value of the temperature parameter lies within the temperature interval predefined by the lower limit temperature and the upper limit temperature. This lower limit temperature can be set to a value between −40° C. and +10° C., in particular to 0° C.

In a further example embodiment, the positioning device can include a positioning motor as well as a positioning mechanism coupled therewith for the purpose of moving a positioning element between two end positions. The positioning device further comprises a sensor for detecting a positioning speed measured variable as defined above. The positioning device further comprises a control unit for driving the positioning motor, to which the positioning speed measured variable of the input signal is supplied. According to the invention, the control unit, which is preferably an integrated circuit or a microcontroller, is designed in terms of its circuitry and/or programming for the purpose of carrying out the method described above in an adjustment mode.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing which are given by way of illustration only, and thus, are not limitive of the present invention, and wherein the sole FIGURE illustrates a schematic view of a positioning device 1 designed as a window opener for a vehicle window 2 of a motor vehicle.

DETAILED DESCRIPTION

The positioning device, according to an exemplary embodiment, can include an electric positioning motor 3, which is coupled via a positioning mechanism 4 to vehicle window 2 in such a way that vehicle window 2 is movable along a travel path 5 between two end positions, namely an open position 6 and a closed position 7.

Positioning mechanism 4 comprises, for example, a driving worm 9 mounted on a drive shaft 8 of a positioning motor 3, the driving worm meshing with a worm gear 10 made of, for example, a plastic material.

Positioning device 1 further comprises a control unit 11 in the form of a microcontroller as well as a rotary position sensor 12.

In an embodiment, rotary position sensor 12 can include a multipole ring magnet 13 mounted on drive shaft 8 as well as a Hall sensor 14 interacting therewith. During operation of the positioning motor 3, ring magnet 13, in interaction with Hall sensor 14, generates a periodically oscillating measurement signal, from which the rotational speed of the positioning motor 3 may be calculated in a manner that is known per se. The rotational speed of the positioning motor 3, in turn, is proportionate to the positioning speed of vehicle window 2. The measurement signal output by Hall sensor 14 therefore represents a positioning speed measured variable U, as defined above. This positioning speed measured variable U is supplied to control unit 11 as an input signal.

Control unit 11, in turn, drives positioning motor 2 via a control signal C, so that—depending on the content of control signal C—the window is moved along the travel path in the direction of open position 6 or in the direction of closed position 7.

A control program (not illustrated in further detail) is implemented in control unit 11. This control program has a normal operating mode as well as an additional adjustment mode.

In normal operating mode, control unit 11 calculates the current position of vehicle window 2 on the basis of positioning speed measured variable U and compares this current position with stored reference values for open position 6 and closed position 7. In normal operating mode, positioning device 1 always ends a closing operation when the calculated current window position reaches a predefined minimum distance from the stored reference value for closed position 7. Therefore, in normal operating mode, i.e. when closing, vehicle window 2 is stopped by default shortly before it comes into contact with the vehicle body.

In adjustment mode, on the other hand, control unit 11 determines actual closed position 7 of vehicle window 2 and stores a corresponding reference value for later use during normal operating mode.

In adjustment mode, control unit 11 drives positioning motor 3 in such a way that vehicle window 2 is moved in the direction of closed position 7 until it actually reaches closed position 7 and vehicle window 2 comes into contact with the vehicle body in this manner. When vehicle window 2 comes in contact with the vehicle body, this necessarily reduces the positioning speed to zero. Control unit 11 thus detects the reaching of closed position 7 by the fact that positioning speed measured variable U drops to zero for a predetermined time interval.

Once control unit 11 has detected the reaching of closed position 7 in this manner, it stops the advance of positioning motor 3 and stores the calculated current window position as a reference value for closed position 7.

The adjustment operation described above is first carried out in a motor vehicle after positioning device 1 had been installed in order to train positioning device 1 to closed position 7 and thus to generate an initial reference value for subsequent operation of positioning device 1 in normal operating mode.

However, the control program is also designed to repeat the adjustment operation from time to time in order to check and, if necessary, adapt the reference value corresponding to closed position 7. For this purpose, the control program automatically switches from normal operating mode to adjustment mode for carrying out every nth closing operation. Letter n in this case stands for a whole number which is predefinable within the scope of the control program. By default, n is set to a value of 50, so that the adjustment operation is started by default upon every fiftieth closing operation.

In the illustrated embodiment, positioning device 1 also comprises a temperature sensor 15 which detects the temperature prevailing in the installation environment of positioning device 1 as temperature parameter T and supplies it to control unit 11 as an input signal.

The control program evaluates this temperature parameter after entering the adjustment mode and compares the temperature measured variable with stored limit temperatures. An upper limit temperature is set, for example, to 50° C. and a lower limit temperature is set, for example, to 0° C. The control program carries out the adjustment operation described above only if the value of the temperature parameter lies within the temperature interval defined by the lower and upper limit temperatures. Otherwise, the control program returns to normal operating mode for the pending closing operation.

The adjustment operation, including the preceding temperature check, is repeated in this case after the next closing operation.

To convert positioning device 1 to vehicle models in which vehicle window 2 must always be moved to the limit stop according to the specifications, it is sufficient to set variable n introduced above to the value 1. In this case, positioning device 1 is operated by default in adjustment mode as long as the temperature remains within the permissible temperature interval.

Deviating from the embodiment described above, temperature sensor 15 may also be integrated into control unit 11.

As an alternative thereto, a temperature inside or outside the vehicle may be used as the temperature parameter instead of the measured value provided by temperature sensor 15. This temperature parameter is provided to control unit 11 by an on-board computer, preferably via a CAN or LIN bus line.

As another alternative, a positioning motor temperature calculated by an overheating protection module (not illustrated in greater detail) may also be used as the temperature parameter. The overheating protection module may be designed as a separate component of positioning device 1 or as a software component of control unit 11.

The adjustment method may also be used in the same manner for determining open position 6.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for adjusting a motorized positioning device for a vehicle, whereby an end position of a positioning element is to be adjusted, the method comprising:

detecting and analyzing a positioning speed measured variable;

evaluating a temperature parameter that is a characteristic of the temperature of the positioning device;

performing an adjustment step for adjusting the end position, during and/or after the evaluating step, only if the value of the temperature parameter does not exceed a predefined upper limit temperature, the adjustment step comprising moving the positioning element in a direction of the end position, wherein the end position is determined when a value of the positioning speed measured variable reaches or drops below a predefined threshold value; and storing the end position determined in the adjustment step for use in normal operation of said motorized positioning device.

2. The method according to claim 1, wherein the upper limit temperature is set to a value between 40° C. and 60° C.

3. The method according to claim 1, wherein the adjustment step is carried out only if the value of the temperature parameter does not drop below a lower limit temperature.

4. The method according to claim 3, wherein the lower limit temperature is set to a value between −40° C. and +10° C.

5. The method according to claim 3, wherein the lower limit temperature is set to a value of about 0° C.

6. The method according to claim 1, wherein the temperature of the positioning device is detected by a temperature sensor as the temperature parameter.

7. The method according to claim 1, wherein a temperature inside the vehicle or a temperature outside the vehicle is used as the temperature parameter.

8. The method according to claim 1, wherein a calculated positioning motor temperature is used as the temperature parameter.

9. The method according to claim 1, wherein the upper limit temperature is set to a value of about 50° C.

10. The method according to claim 1, wherein the positioning element is movable along a predefined travel path between two end positions during normal operation, one of which is delimited by the stored end position.

11. A positioning device for a window opener, the positioning device comprising:

a positioning motor;

a positioning mechanism coupled with the positioning motor for moving a positioning element between two end positions;

a sensor for detecting a positioning speed measured variable; and a control unit for driving the positioning motor to which the positioning speed measured variable is supplied as an input signal, the control unit being configured to:

detect and analyze a positioning speed measured variable;

evaluate a temperature parameter that is a characteristic of the temperature of the positioning device;

perform an adjustment step for adjusting one of said end positions, during and/or after the evaluation, only if the value of the temperature parameter does not exceed a predefined upper limit temperature, the adjustment step comprising moving the positioning element in a direction of the end position to be adjusted, wherein the end position is detected and determined when a value of the positioning speed measured variable reaches or drops below a predefined threshold value; and store the end position determined in the adjustment step for use in normal operation of said motorized positioning device.

* * * * *

UNITED STATES PATENT AND TRADEMARK OFFICE

CERTIFICATE OF CORRECTION

PATENT NO. : 8,141,300 B2
APPLICATION NO. : 12/476021
DATED : March 27, 2012
INVENTOR(S) : Heckmann et al.

It is certified that error appears in the above-identified patent and that said Letters Patent is hereby corrected as shown below:

Title Page

Change from:

(75) Inventors: Felix Heckmann, Coburg (DE)

To:

(75) Inventors: Felix Heckmann, Singen-Bohlingen (DE)

Signed and Sealed this
Twenty-ninth Day of May, 2012

David J. Kappos

David J. Kappos
*Director of the United States Patent and Trademark Office*